US006434246B1

(12) United States Patent
Kates et al.

(10) Patent No.: US 6,434,246 B1
(45) **Date of Patent: *Aug. 13, 2002**

(54) APPARATUS AND METHODS FOR COMBINING AUDIO COMPRESSION AND FEEDBACK CANCELLATION IN A HEARING AID

(75) Inventors: James Mitchell Kates, Niwot; John Laurence Melanson, Boulder, both of CO (US)

(73) Assignee: GN ReSound as (DK)

( * ) Notice: Subject to any disclaimer, the term of this patent is extended or adjusted under 35 U.S.C. 154(b) by 24 days.

This patent is subject to a terminal disclaimer.

(21) Appl. No.: 09/165,825

(22) Filed: Oct. 2, 1998

Related U.S. Application Data

(63) Continuation of application No. 08/870,426, filed on Jun. 6, 1997, now Pat. No. 6,097,824, which is a continuation of application No. 08/972,265, filed on Nov. 18, 1997, now Pat. No. 6,072,884, which is a continuation of application No. 08/540,534, filed on Oct. 10, 1995, now abandoned.

(60) Provisional application No. 60/080,376, filed on Apr. 1, 1998.

(51) Int. Cl.[7] ..... H04R 25/01

(52) U.S. Cl. ..... 381/312; 381/317; 381/318; 381/71.7

(58) Field of Search ..... 381/312, 71.7, 381/317, 318, 320, 321, 71.6, 68.2, 71.12, 71.11

(56) References Cited

U.S. PATENT DOCUMENTS

| | | | | |
|---|---|---|---|---|
| 3,894,195 A | * | 7/1975 | Kryter | |
| 3,947,636 A | * | 3/1976 | Edgar | |
| 4,689,818 A | | 8/1987 | Ammitzboll | 381/68 |
| 4,718,099 A | * | 1/1988 | Hotvet | |
| 4,731,850 A | | 3/1988 | Levitt et al. | 381/68.2 |
| 5,016,280 A | | 5/1991 | Engebretson et al. | 381/68 |
| 5,019,952 A | | 5/1991 | Smolenski et al. | 363/16 |
| 5,091,952 A | * | 2/1992 | Williamson et al. | 381/68.2 |
| 5,500,902 A | | 3/1996 | Stockham, Jr. et al. | 381/68.4 |
| 6,072,884 A | * | 6/2000 | Kates | 381/318 |
| 6,097,824 A | * | 8/2000 | Lindemann et al. | 381/315 |
| 6,104,822 A | * | 8/2000 | Melanson et al. | 381/320 |

OTHER PUBLICATIONS

Lybarger, Samuel F., "Acoustic Feedback Control," *The Vanderbilt Hearing–Aid Report*, Studebaker and Bess, Eds. Upper Darby, PA: Monographs in Contemporary Audiology, pp. 87–90, 1982.

Kates, James M., "A Computer Simulation of Hearing Aid Response and the Effects of Ear Canal Size," J. Acoust. Soc. Am., vol. 83 (5), pp. 1952–1963, May 1988.

(List continued on next page.)

*Primary Examiner*—Curtis Kuntz
*Assistant Examiner*—P. Dabney
(74) *Attorney, Agent, or Firm*—Jennifer L. Bales; Macheledt Bales LLP

(57) ABSTRACT

The present invention combines audio compression and feedback cancellation in an audio system such as a hearing aid. The feedback cancellation element of the present invention uses one or more filters to model the feedback path of the system and thereby subtract the expected feedback from the audio input signal before hearing aid processing occurs. The hearing aid processing includes audio compression, for example multiband compression. The operation of the audio compression element may be responsive to information gleaned from the feedback cancellation element, the feedback cancellation may be responsive to information gleaned from the compression element, or both.

20 Claims, 6 Drawing Sheets

OTHER PUBLICATIONS

Egolf, David P., "Review of the Acoustic Feedback Literature from a Control Systems Point of view," *The Vanderbilt Hearing–Aid Report*, Studebaker and Bess, Eds. Upper Darby, PA: Monographs in Contemporary Audiology, pp. 94–103, 1982.

Bustamante, Diane K., Thomas L. Worrall, and Malcolm J. Williamson, "Measurement and Adaptive Suppression of Acoustic Feedback in Hearing Aids," ICASSP '89 Proceedings, Glasgow, pp. 2017–2020, 1989.

Engebretson, A. Maynard, Michael P. O'Connell, and Fengmin Gong, "An Adaptive Feedback Equalization Algorithm for the CID Digital Hearing Aid," Annual International Conference for the IEEE Engineering in Medicine and Biology Society, Part 5, vol. 12, No. 5, Philadelphia, PA, pp. 2286–2287, 1990.

Kates, James M., "Feedback Cancellation in Hearing Aids: Results from a Computer Simulation," IEEE Transactions on Signal Processing, vol. 39, No. 3, pp. 553–562, Mar. 1991.

Drylund, Ole and Nikolai Bisgaard, "Acoustic Feedback Margin Improvements in Hearing Instruments Using a Prototype DFS (Digital Feedback Suppression) System," Scand Audiol, vol. 20, pp. 49–53, 1991.

Engebretson, A. Maynard, and Marilyn French–St. George, "Properties of an Adaptive Feedback Equalization Algorithm," Journal of Rehabilitation Research and Development, vol. 30, No. 1, pp. 8–16, 1993.

French–St. George, Marilyn, Douglas J. Wood, and A. Maynard Engebretson, "Behavioral Assessment of Adaptive Feedback Equalization in a Digital Hearing Aid," Journal of Rehabilitation Research and Development, vol. 30, No. 1, pp. 17–25, 1993.

Bisgaard, Nikolai, "Digital Feedback Suppression—Clinical Experiences with Profoundly Hearing Impaired," *Recent Developments in Hearing Instrument Technology: 15th Danavox Symposium*, J. Beilin and G.R. Jensen, Eds., Kolding, Denmark, pp. 370–384, 1993.

Dyrlund, Ole, Lise B. Henningsen, Nikolai Bisgaard, and Janne H. Jensen, "Digital Feedback Suppression: Characterization of Feedback–margin Improvements in a DFS Hearing Instrument," Scand. Audiol., vol. 23, pp. 135–138, 1994.

Widrow, Bernard, John M. McCool, Michael G. Larimore, and C. Richard Johnson, Jr., "Stationary and Nonstationary Learning Characteristics of the LMS Adaptive Filter," Proc. IEEE, vol. 64, No. 8, pp. 1151–1162, Aug. 1976.

Maxwell, Joseph A., and Patrick M. Zurek, "Reducing Acoustic Feedback in Hearing Aids," I E E E Transactions on Speech and Audion Processing, vol. 3, No. 4, Jul. 1995.

Makhoul, John, "Linear Prediction: A Tutorial Review," Proceedings of the IEEE, vol. 63, No. 4, pp. 561–580, Apr. 1975.

Woodruff, Brian D., and David A Preves, "Fixed Filter Implementation of Feedback Cancellation for In–The–Ear Hearing Aids," Proc. 1995 IEEE ASSP Workshop on Applications of Signal Processing to Audio and Acoustics, New Paltz, NY, paper 1.5, 1995.

Chabries, Douglas M., Richard W. Christiansen, Robert H. Brey, Martin S. Robinette, and Richard W. Harris, "Application of Adaptive Digital Signal Processing to Speech Enhancement for the Hearing Impaired," Journal of Rehabilitation Research and Development 24:4 (1987), pp. 65–74.

Glasberg, Brian R., and Brian C.J. Moore, "Auditory Filter Shapes in Subjects with Unilateral and Bilateral Cochlear Impairments," Journal of the Acoustical Society of Americal 79:4 (1986), pp. 1020–1033.

Killion, Mead C., "The K–Amp Hearing Aid: An Attempt to Present High Fidelity for Persons With Impaired Hearing," American Speech–Language–Hearing Association, AJA (1993), pp. 52–74.

Kollmeier, B., "Speech Enhancement by Filtering in the Loudness Domain," Acta Otolaryngol (Stockh) (1990), Suppl. 469, pp. 207–214.

Lippmann, R.P., L.D. Braida, and N.I. Duriach, "Study of Mutlichannel Amplitude compression and linear amplification for Persons with Sensorineural Hearing Loss," Journal of the Acoustical Society of America 69:2 (1981), pp. 524–534.

Moore, Brian C.J., "How Much Do We Gain by Gain Control in Hearing Aids?" Acta Otolaryngol (Stockh) (1990), Suppl. 469, pp. 250–256.

Moore, Brian C.J., Brian R. Glasberg, and Michael A. Stone, "Optimization of a Slow–Acting Automatic Gain Control System for Use in Hearing Aids," British Journal of Audiology 25 (1991), pp. 171–182.

Moore, Brian C.J., Jeannette Seloover Johnson, Teresa M. Clark, and Vincent Pluvinage, "Evaluation of a Dual–Channel Full Dynamic Range Compression System for People with Sensorineural Hearing Loss," Ear and Hearing 13:5 (1992), pp. 349–370.

Nabelek, Igor V., "Performance of Hearing–Impaired Listeners Under Various Types of Amplitude Compression," Journal of the Acoustical Society of America 74:3 (1983), pp. 776–791.

Plomp, Reinier, "The Negative Effect of Amplitude Compression in Multichannel Hearing Aids in the Light of the Modulation–Transfer Function," Journal of the Acoustical Society of America 83:6 (1988), pp. 2322–2327.

Villchur, Edgar, "Comments on 'The Negative Effect of Amplitude Compression in Multichannel Hearing Aids in the Light of the Modulation–Transfer Function'," Journal of the Acoustical Society of America 86:1 (1989), pp. 425–427.

Plomp, Reinier, "Reply to 'Comments on "The Negative Effect of Amplitude compression in Multichannel Hearing Aids in the Light of the Modulation–Transfer Function"'," Journal of the Acoustical Society of America 86:1 (1989), p. 428.

Waldhauer, Fred, and Edgar Villchur, "Full Dynamic Range Multiband Compression In a Hearing Aid," The Hearing Journal (1988), pp. 1–4.

Walker, Gary, Denis Byrne, and Harvey Dillon, "The Effects of Multichannel Compression/Expansion Amplification on the Intelligibility of Nonsense Syllables in Noise," Journal of the Acoustical Society of America 76:3 (1984), pp. 746–757.

Yanick, Jr., Paul, "Effects of Signal Processing on Intelligibility of Speech in Noise for Persons with Sensorineural Hearing Loss," Journal of the American Audiological Society 1:5 (1976), pp. 229–238.

Ho, K.C., and Y.T. Chan, "Bias Removal in Equation–Error Adaptive IIR Filters," IEEE Transactions on Signal Processing, vol. 43, No. 1, pp. 51–62, Jan. 1995.

* cited by examiner

APPARATUS AND METHODS FOR COMBINING AUDIO COMPRESSION AND FEEDBACK CANCELLATION IN A HEARING AID

This application claims the benefit of U.S. Provisional Application No. 60/080,376, filed Apr. 1, 1998, and is a continuation of patent application Ser. No. 08/870,426, filed Jun. 6, 1997 now U.S. Pat. No. 6,097,824 and entitled "Spectral Sampling Multiband Audio Compressor," which is a continuation of patent application Ser. No. 08/972,265, filed Nov. 18, 1997 now U.S. Pat. No. 6,072,884 and entitled "Feedback Cancellation Apparatus and Methods," and which is a continuation of patent application Ser. No. 08/540,534, filed Oct. 10, 1995 now abandoned and entitled "Digital Signal Processing Hearing Aid" are incorporated herein by reference.

BACKGROUND OF THE INVENTION

1. Field of the Invention

The present invention relates to apparatus and methods for combining audio compression and feedback cancellation in audio systems such as hearing aids.

2. Description of the Prior Art

Mechanical and acoustic feedback limits the maximum gain that can be achieved in most hearing aids. System instability caused by feedback is sometimes audible as a continuous high-frequency tone or whistle emanating from the hearing aid. Mechanical vibrations from the receiver in a high-power hearing aid can be reduced by combining the outputs of two receivers mounted back-to-back so as to cancel the net mechanical moment; as much as 10 dB additional gain can be achieved before the onset of oscillation when this is done. But in most instruments, venting the BTE earmold or ITE shell establishes an acoustic feedback path that limits the maximum possible gain to less than 40 dB for a small vent and even less for large vents. The acoustic feedback path includes the effects of the hearing aid amplifier, receiver, and microphone as well as the vent acoustics.

The traditional procedure for increasing the stability of a hearing aid is to reduce the gain at high frequencies. Controlling feedback by modifying the system frequency response, however, means that the desired high-frequency response of the instrument must be sacrificed in order to maintain stability. Phase shifters and notch filters have also been tried, but have not proven to be very effective.

A more effective technique is feedback cancellation, in which the feedback signal is estimated and subtracted from the microphone signal. One particularly effective feedback cancellation scheme is disclosed in patent application Ser. No. 08/972,265, now U.S. Pat. No. 6,072,884 entitled "Feedback Cancellation Apparatus and Methods," incorporated herein by reference.

Another technique often used in hearings aids is audio compression of the input signal. Both single band and multiband dynamic range compression is well known in the art of audio processing. Roughly speaking, the purpose of dynamic range compression is to make soft sounds louder without making loud sounds louder (or equivalently, to make loud sounds softer without making soft sounds softer). Therefore, one well known use of dynamic range compression is in hearing aids, where it is desirable to boost low level sounds without making loud sounds even louder.

The purpose of multiband dynamic range compression is to allow compression to be controlled separately in different frequency bands. Thus, high frequency sounds, such as speech consonants, can be made louder while loud environmental noises—rumbles, traffic noise, cocktail party babble—can be attenuated.

Patent application Ser. No. 08/540,534, entitled "Digital Signal Processing Hearing Aid," incorporated herein by reference, gives an extended summary of multiband dynamic range compression techniques with many references to the prior art.

Patent application Ser. No. 08/870,426, entitled "Continuous Frequency Dynamic Range Audio Compressor," incorporated herein by reference, teaches another effective multiband compression scheme.

A need remains in the art for apparatus and methods to combine audio compression and feedback cancellation in audio systems such as hearing aids.

SUMMARY OF THE INVENTION

The primary objective of the combined audio compression and feedback cancellation processing of the present invention is to eliminate "whistling" due to feedback in an unstable hearing aid amplification system, while make soft sounds louder without making loud sounds louder, in a selectable manner according to frequency.

The feedback cancellation element of the present invention uses one or more filters to model the feedback path of the system and thereby subtract the expected feedback from the audio signal before hearing aid processing occurs. The hearing aid processing includes audio compression, for example multiband compression.

As features of the present invention, the operation of the audio compression element may be responsive to information gleaned from the feedback cancellation element, the feedback cancellation may be responsive to information gleaned from the compression element, or both.

A hearing aid according to a first embodiment of the present invention comprises a microphone for converting sound into an audio signal, feedback cancellation means including means for estimating a physical feedback signal of the hearing aid, and means for modelling a signal processing feedback signal to compensate for the estimated physical feedback signal, subtracting means, connected to the output of the microphone and the output of the feedback cancellation means, for subtracting the signal processing feedback signal from the audio signal to form a compensated audio signal, a hearing aid processor including audio compression means, connected to the output of the subtracting means, for processing the compensated audio signal, and a speaker, connected to the output of the hearing aid processor, for converting the processed compensated audio signal into a sound signal.

In a second embodiment, the feedback cancellation means provides information to the compression means , and the compression means adjusts its operation in accordance with this information. For example, an increase in the magnitude of the zero coefficient vector can indicate the presence of an incoming sinusoid, which is likely due to feedback oscillations in the hearing aid. The maximum gain of the audio compression at low levels can be reduced if the feedback cancellation means detects an increase in the magnitude of the zero coefficient vector.

In a third embodiment, the compression means provides information, for example input signal power levels at various frequencies, to the feedback cancellation means, and the feedback cancellation element adjusts its operation in accordance with this information. For example, the feedback cancellation adaptation constant can be adjusted based upon the power level of one or more of the frequency bands of the audio compressor. For example, the adaptation time constant of the feedback cancellation element could be adjusted based on the output of one of the compression bands or a weighted combination of two or more bands.

In a fourth embodiment, the compression means provides information to the feedback cancellation means, and the feedback cancellation means provides information to the compression means, and each element adjusts its operation in accordance with the information obtained from the other.

DETAILED DESCRIPTION OF THE PREFERRED EMBODIMENT

Figure 1:
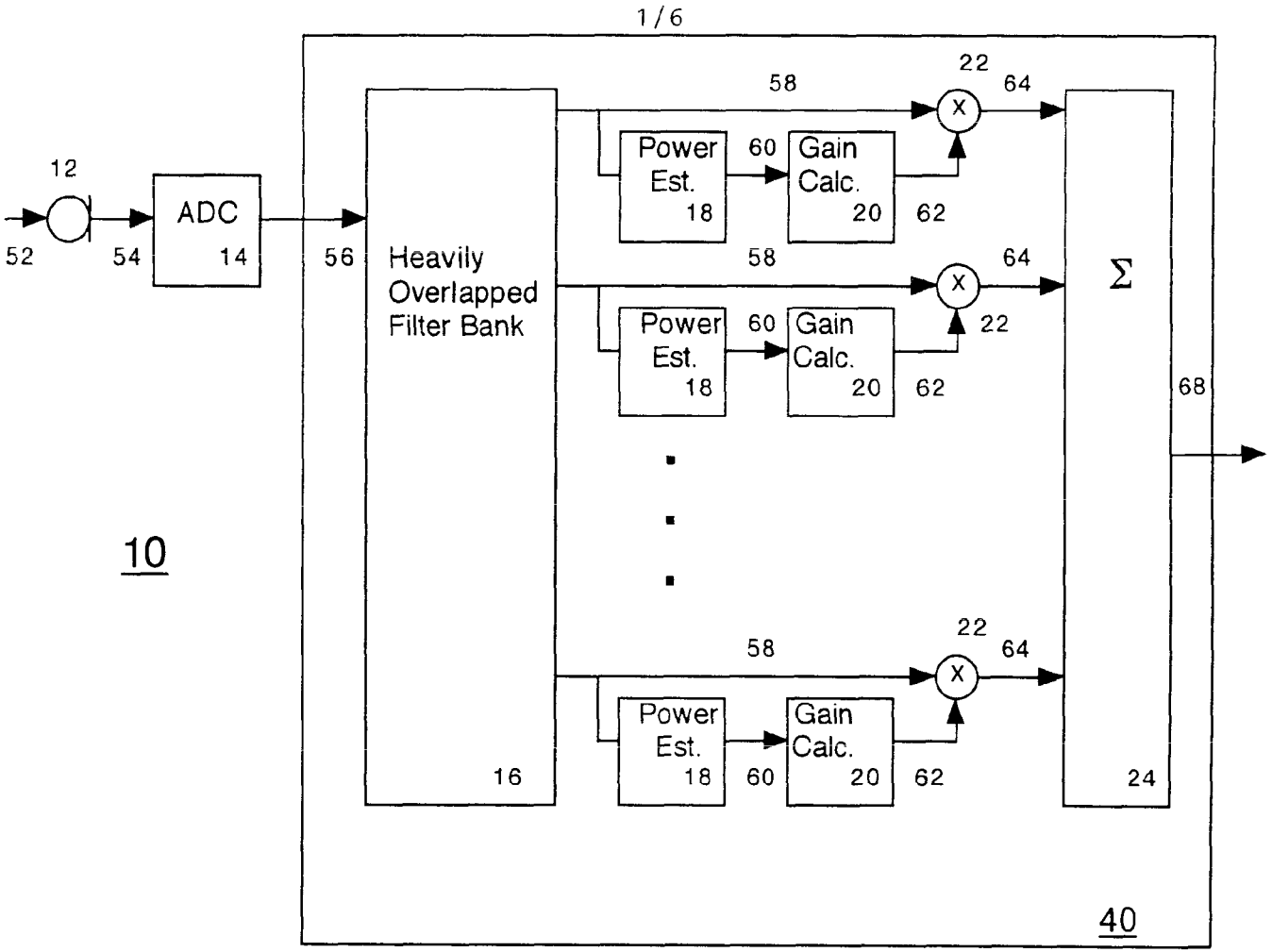
FIGURE 1 (Prior Art)
FIG. 1 (prior art) is a flow diagram showing a hearing aid incorporating multiband audio compression.

FIG. 1 (prior art) is a flow diagram showing an example of a hearing aid 10 incorporating multiband audio compression 40. This invention is described in detail in U.S. patent application Ser. No. 08/870,426, entitled "Spectral Sampling Multiband Audio Compressor." An audio input signal 52 enters microphone 12, which generates input signal 54. Signal 54 is converted to a digital signal by analog to digital converter 15, which outputs digital signal 56. This invention could be implemented with analog elements as an alternative. Digital signal 56 is received by filter bank 16, which is implemented as a Short Time Fourier Transform system, where the narrow bins of the Fourier Transform are grouped into overlapping sets to form the channels of the filter bank. However, a number of techniques for constructing filter banks in the frequency domain or in the time domain, including Wavelets, FIR filter banks, and IIR filter banks, could be used as the foundation for filter bank design.

Filter bank 16 filters signal 56 into a large number of heavily overlapping bands 58. Each band 58 is fed into a power estimation block 18, which integrates the power of the band and generates a power signal 60. Each power signal 60 is passed to a dynamic range compression gain calculation block, which calculates a gain 62 based upon the power signal 60 according to a predetermined function.

Multipliers 22 multiply each band 58 by its respective gain 62 in order to generate scaled bands 64. Scaled bands 64 are summed in adder 24 to generate output signal 68. Output signal 68 may be provided to a receiver (not shown) in hearing aid 10 or may be further processed.

Figure 2:
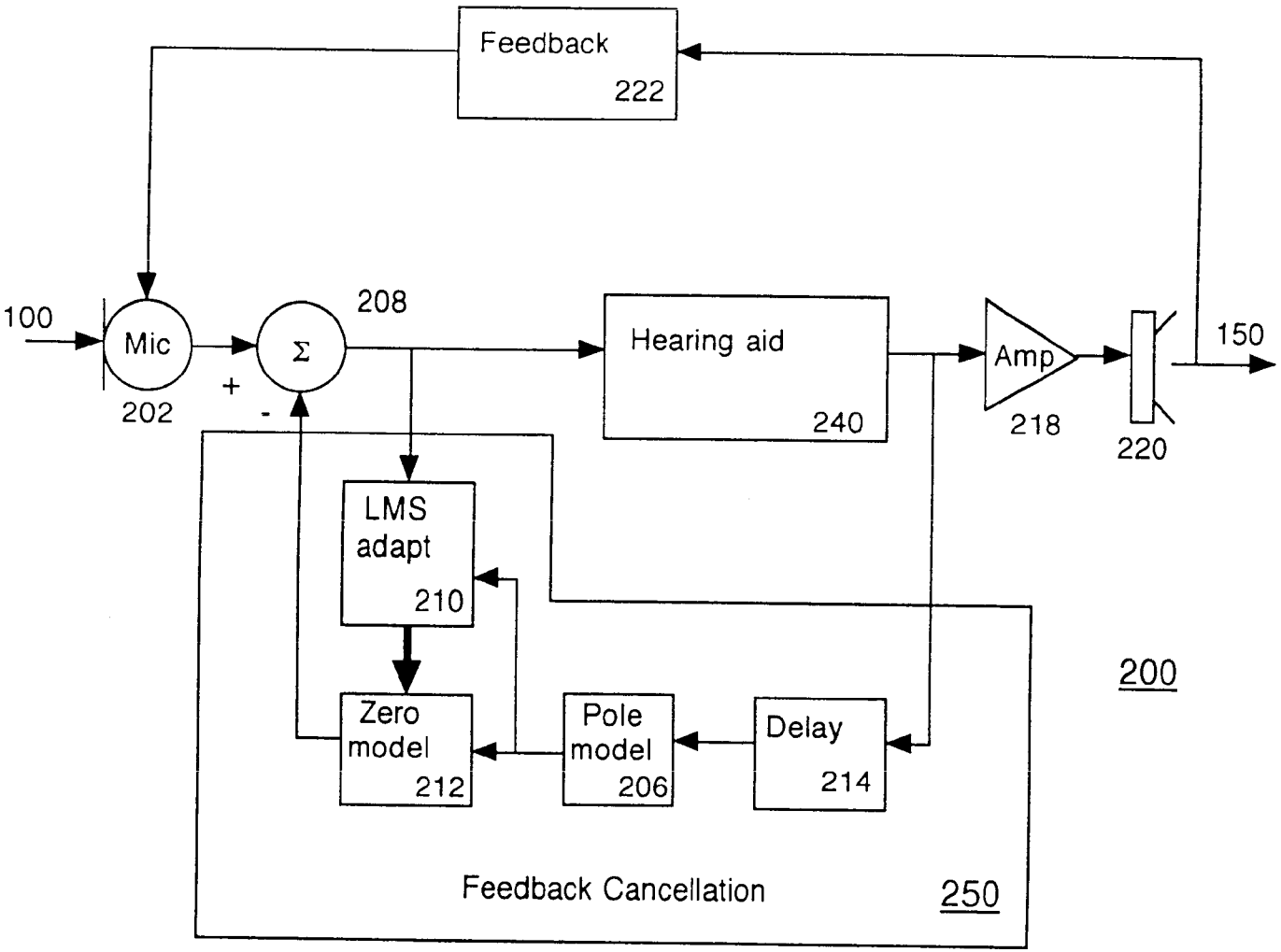
Figure 2 (Prior Art)
FIG. 2 (prior art) is a block diagram showing a hearing aid incorporating feedback cancellation.

FIG. 2 (prior art) is a block diagram showing a hearing aid incorporating feedback cancellation. This invention is described in detail in patent application Ser. No. 08/972,265, entitled "Feedback Cancellation Apparatus and Methods. Feedback path modelling 250 includes the running adaptation of the zero filter coefficients. The series combination of the frozen pole filter 206 and the zero filter 212 gives a model transfer function G(z) determined during start-up. The coefficients of the pole model filter 206 are kept at values established during start-up and no further adaptation of these values takes place during normal hearing aid operation. Once the hearing aid processing is turned, on zero model filter 212 is allowed to continuously adapt in response to changes in the feedback path as will occur, for example, when a telephone handset is brought up to the ear.

During the running processing shown in FIG. 2, no separate probe signal is used, since it would be audible to the hearing aid wearer. The coefficients of zero filter 212 are updated adaptively while the hearing aid is in use., The output of hearing aid processing 240 is used as the probe. In order to minimize the computational requirements, the LMS adaptation algorithm is used by block 210. The adaptation is driven by error signal e(n) which is the output of the summation 208. The inputs to the summation 208 are the signal from the microphone 202, and the feedback cancellation signal produced by the cascade of the delay 214 with the all-pole model filter 206 in series with the zero model filter 212. The zero filter coefficients are updated using LMS adaptation in block 210.

Figure 3:
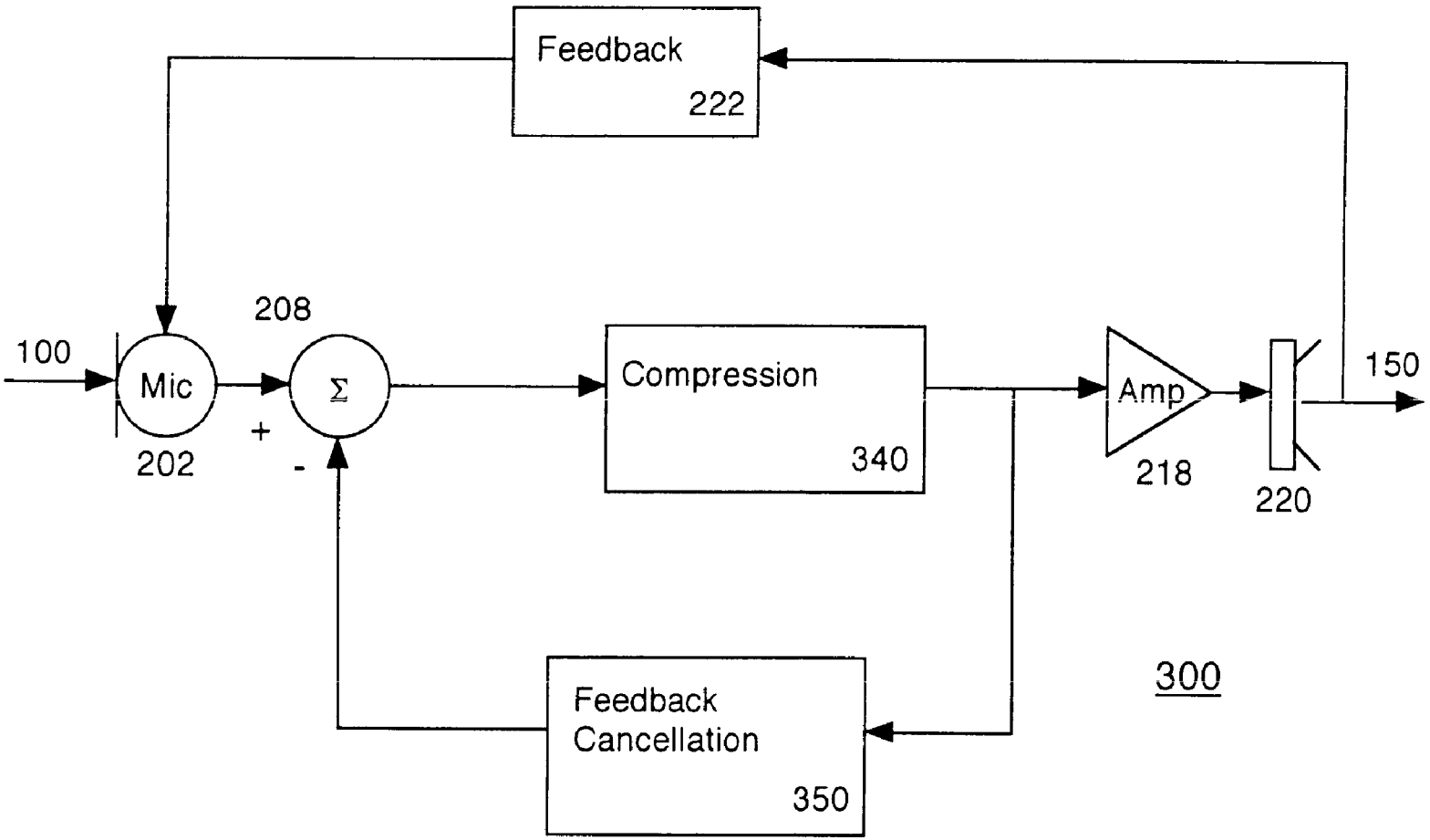
FIG. 3 is a block diagram showing a hearing aid according to the present invention, incorporating compression and feedback cancellation.

FIG. 3 is a block diagram showing a hearing aid 300 according to the present invention, incorporating compression 340 and feedback cancellation 350. Other types of hearing aid processing, for example direction sensitivity or noise suppression, could also be incorporated into block 340. An example of a compression scheme which could be used is shown in block 40 of FIG. 1, but the invention is by no means limited to this particular compression scheme. Many kinds of compression could be used. Similarly, an example of feedback cancellation is shown in block 250 of FIG. 2, but many other types of feedback cancellation could be used instead, including algorithms operating in the frequency domain as well as in the time domain.

Microphone 202 converts input sound 100 into an audio signal. Though this is not shown, the audio signal would generally be converted into a digital signal prior to processing. Feedback cancellation means 350 estimates a physical feedback signal of hearing aid 300, and models a signal processing feedback signal to compensate for the estimated physical feedback signal. Subtracting means 208, connected to the output of microphone 202 and the output of feedback cancellation means 350, subtracts the signal processing feedback signal from the audio signal to form a compensated audio signal. Compression processor 340 is connected to the output of subtracting means 208, for processing the compensated audio signal. Speaker 220, connected to amplifier 218 at the output of hearing aid processor 340, converts the processed compensated audio signal into a sound signal. If the processed compensated audio signal is a digital signal, it is converted back to analog (not shown).

Figure 4:
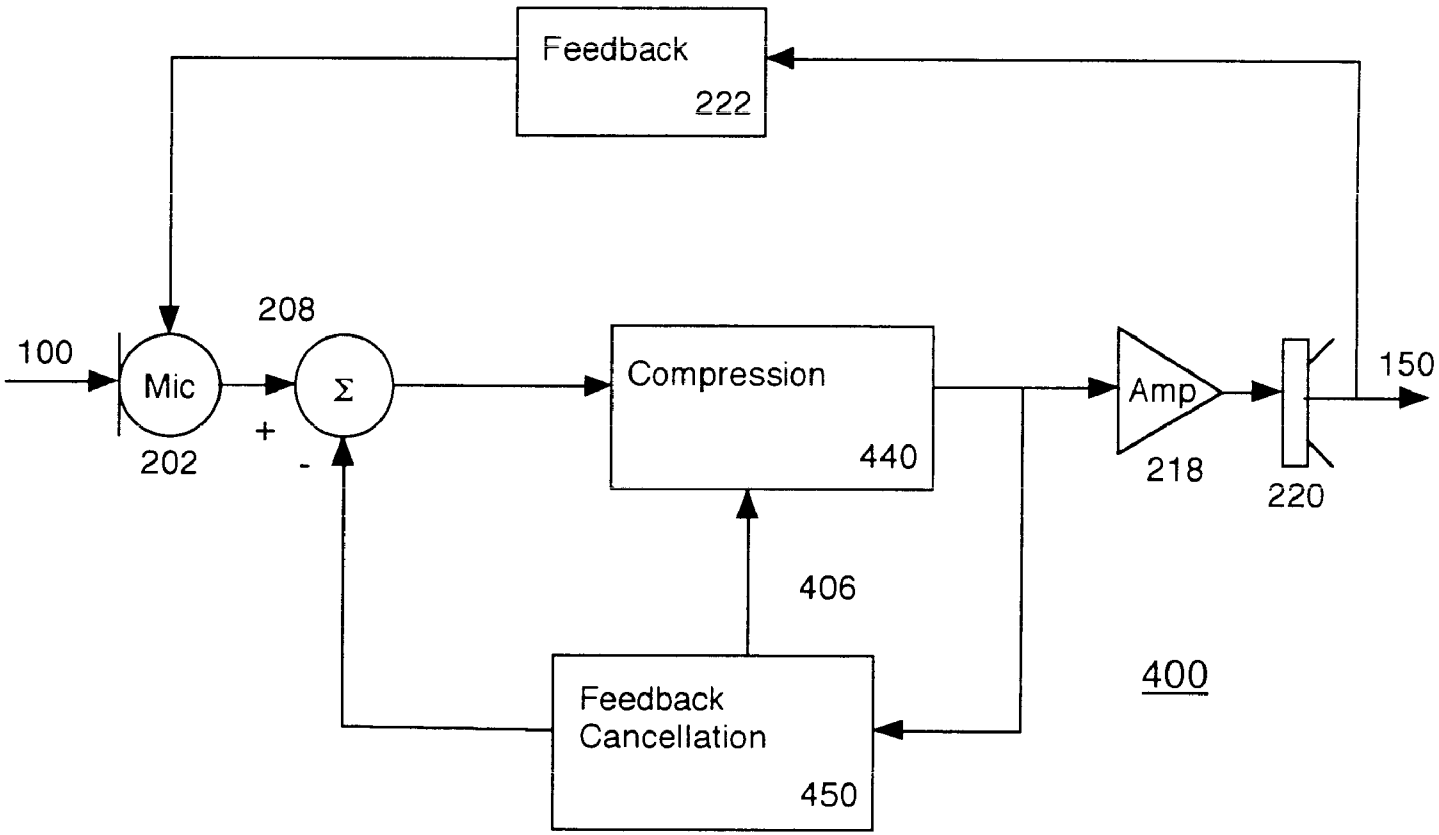
FIG. 4 is a block diagram showing a hearing aid according to the present invention, incorporating compression and feedback cancellation, wherein the compression element modifies its operation according to information from the feedback cancellation.

FIG. 4 is a block diagram showing a hearing aid 400 which is very similar to hearing aid 300 of FIG. 3, except that compression element 440 modifies its operation according to information from feedback cancellation 450. Depending upon the type of feedback cancellation, the types of information available and useful to compression block 440 will vary. Taking as an example a feedback cancellation block 450 identical to 250 of FIG. 2, the coefficients of zero model 212 will change with time as feedback cancellation 350 attempts to compensation for feedback.

Testing one or more of these coefficients to determine whether they are outside expected ranges in magnitude, or are changing faster than expected, gives a clue as to whether feedback cancellation 350 is having difficulty compensating for the feedback. For example, an increase in the magnitude of the zero coefficient vector might indicate the presence of an incoming sinusoid.

If it appears that feedback compensation 450 is having trouble compensating for feedback, signal 406 would indicate to compression block 440 to lower gain at low levels, either for all frequencies or for selected frequencies. Thus, if compression block 440 is identical to compression block 100 of FIG. 1, signal 406 would be used to generate a control signal for one or more gain calculation blocks 20. For example, the gain for frequencies between 1.5 KHz and 3 KHz might be lowered temporarily, as these are often the frequencies at which hearing aids are unstable. As another example, the kneepoint between the linear amplification function of compression 440 and the compression function at higher signal levels could be moved to a higher signal level. Once the zero model coefficients begin behaving normally, the gain applied by compression 440 can be partially or completely restored to normal. As a third example, the attack and/or release times of the compression 440 could be modified in response to changes in the zero model coefficients. The compressor release time, for example, can be increased when the magnitude of the zero filter coefficient vector increases and returned to its normal value when the magnitude of the zero coefficient vector decreases, thus ensuring that the compression stays at lower gains for a longer period of time when the magnitude of the zero coefficient vector is larger than normal.

Figure 5:
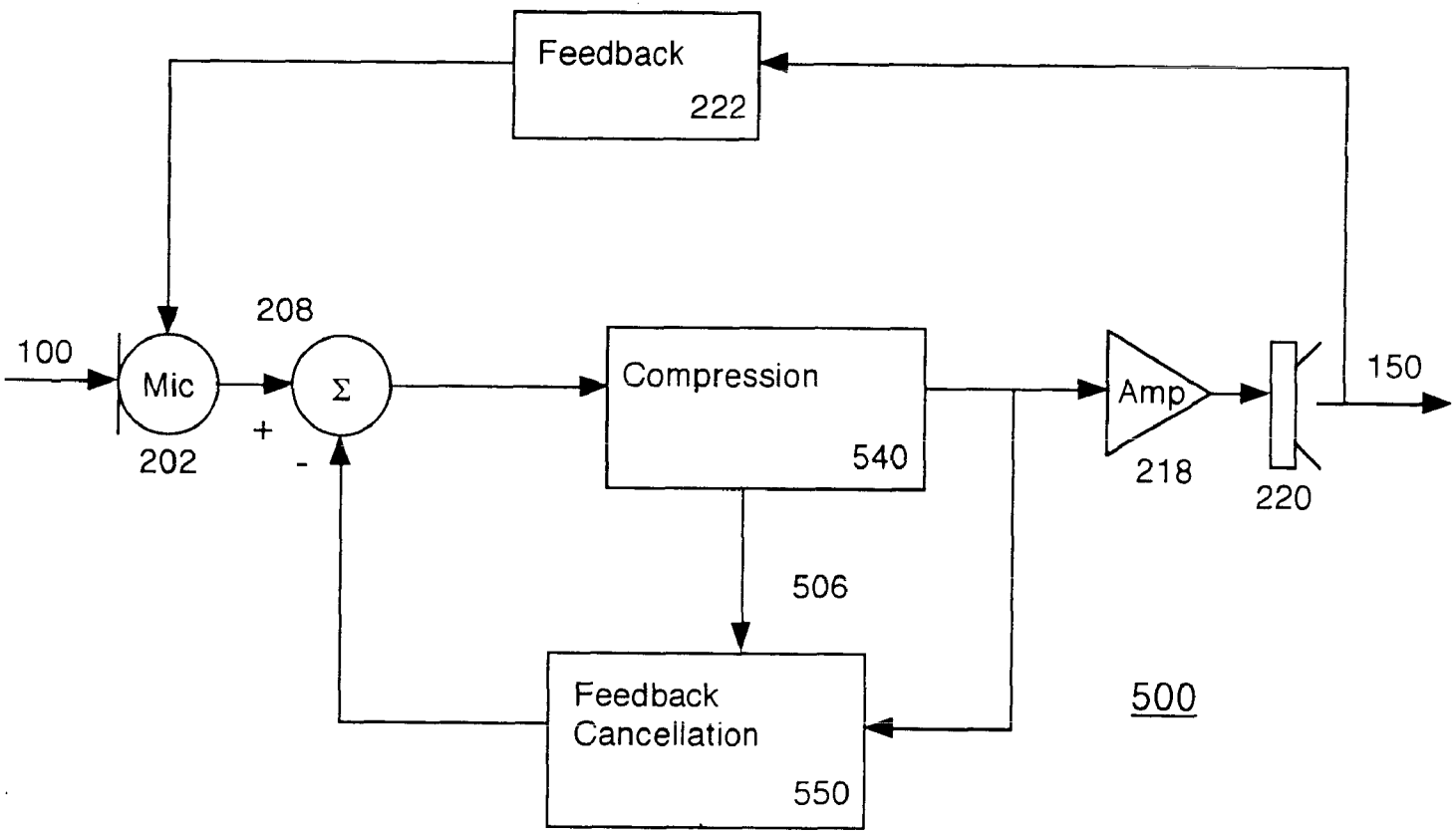
FIG. 5 is a block diagram showing a hearing aid according to the present invention, incorporating compression and feedback cancellation, wherein the feedback cancellation element modifies its operation according to information from the compression element.

FIG. 5 is a block diagram showing a hearing aid 500 which is very similar to hearing aid 300 of FIG. 3, except that feedback cancellation element 550 modifies its operation according to information from compression element 540. For example, the adaptation time constant of feedback cancellation 550 could be adjusted based on the output of one of the compression bands.

The adaptive filter (zero model 212 in FIG. 2) used for feedback cancellation 550 adapts more rapidly and converges to a more accurate solution when the hearing aid input signal is broadband (e.g. White noise) than when it is narrowband (e.g. A tone). Better feedback cancellation system performance can be obtained by reducing the rate of adaptation when a narrowband input signal is detected. The rate of adaptation is directly proportional to the parameter (in the LMS update equation below. The spectral analysis performed by the multiband compression can be used to determine the approximate bandwidth of the incoming signal. The rate of adaptation for the adaptive feedback cancellation filter weight updates is then decreased ((made smaller) as the estimated input signal bandwidth decreases.

As another example, the magnitude of the step size used in the LMS adaptation 210 (see FIG. 2) can be made inversely proportional to the power in one or more compression bands, for example as determined by power estimation blocks 18 (see FIG. 1). In this particular example,, the adaptive update of the zero filter weights becomes:

$$b_k(n+1) = b_k(n) + \frac{2\mu}{\sigma_x^2(n)} e(n)d(n-k),$$

$b_k(n+1)$ is the kth zero filter coefficient at time n+1, e(n) is the error signal provided by subtraction means 208, d(n−k) is the input to the adaptive filter at time n delayed by k samples, and $\sigma_x^2$ (n) is the estimated power at time n from compression 540

In particular, the filtered hearing aid input power can be obtained from one of the frequency bands of compression 540 (from one of power estimation blocks 18 shown in FIG. 1, for example). This adaptation approach offers the advantage of reduced computational requirements, since the power estimate is already available from compression 540, while giving much faster adaptation at lower signal levels than is possible with a system which does not use power normalization 506. Feedback compensation 550 will also adjust faster when normalized based on compression 540 input power rather than feedback compensation 550 input power, because the latter signal has been compressed, raising the level of less intense signals and thus reducing the adaptation step size after power normalization.

Another example of adjusting feedback compensation 550 operation based upon information from compression 540 is the following. The cross correlation calculation used in LMS adapt block 210 (see FIG. 2) can overflow the accumulator if the input signal to hearing aid 500 is too high. By testing the power level of the input signal to compression 540, it is possible to determine whether the input signal is high enough to make such an overflow likely, and freeze the filter coefficients until the high input signal level drops to normal.

The test used is whether:

$$gp\sigma_x^2(n) < \theta,$$

where $\sigma_x^2$ (n) is the estimated power at time n of the hearing aid input signal, g is the gain in the filter band used to estimate power, q is the gain in pole filter 206, and θ is the maximum safe power level to avoid overflow If this test is not satisfied, the adaptive filter update is not performed for that data block. Rather, the filter coefficients are frozen at their current level until the high input signal level drops to normal.

As another example, the magnitude of the step size used in the LMS adaptation 210 (see FIG. 2) can be made dependent on the envelope fluctuations detected in one or more compression bands. A sinusoid will have very little fluctuation in its signal envelope, while noise will typically have large fluctuations. The envelope fluctuations can be estimated by detecting the peaks and valleys of the signal and taking the running difference between these two values. The adaptation step size can then be made smaller as the detected envelope fluctuations decrease.

Figure 6:
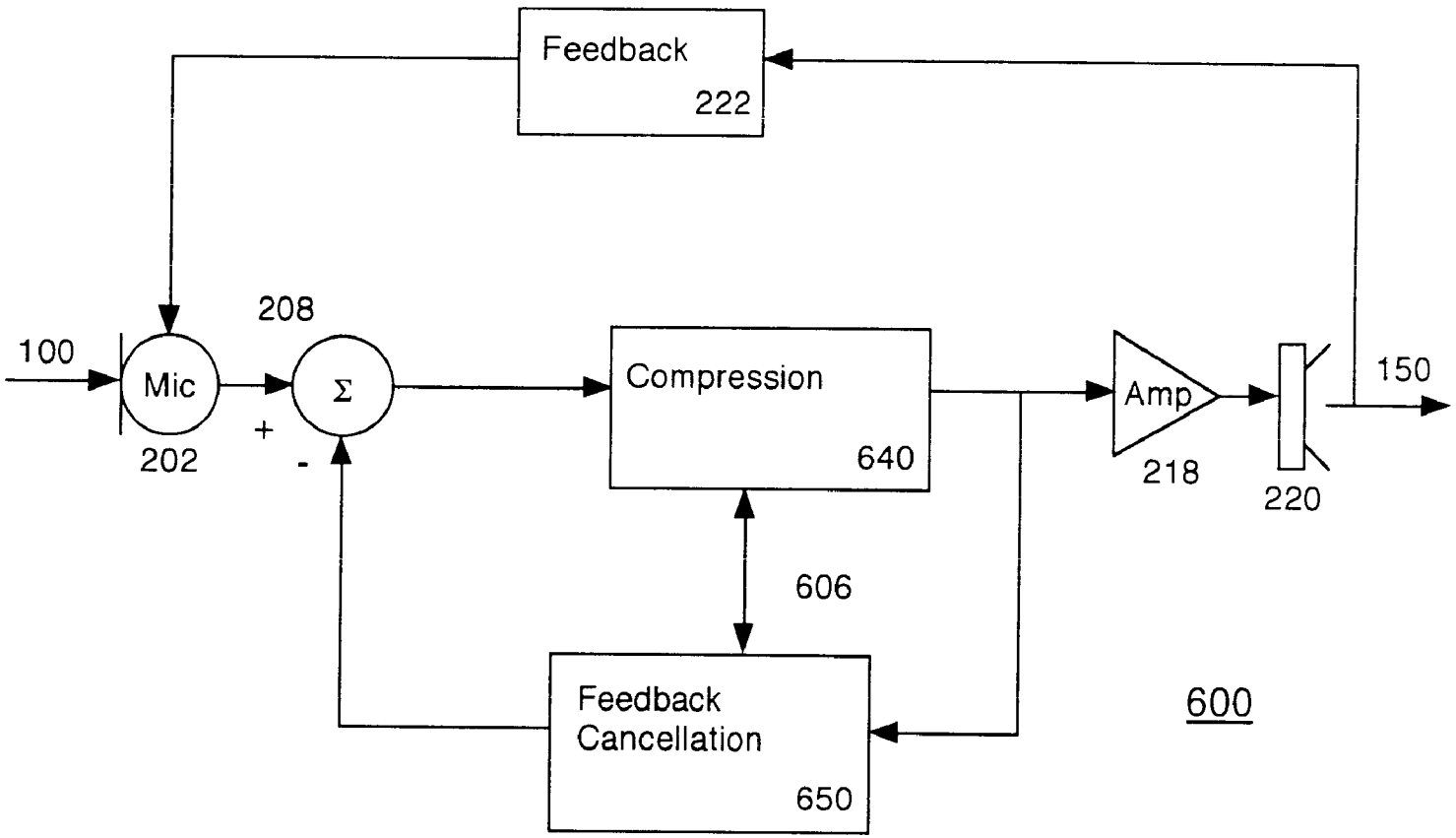
FIG. 6 is a flow diagram showing a hearing aid according to the present invention, incorporating compression and feedback cancellation, wherein the compression element modifies its operation according to information from the feedback cancellation, and the feedback cancellation element modifies its operation according to information from the compression element.

FIG. 6 is a flow diagram showing a hearing aid 600 which is very similar to hearing aid 300 of FIG. 3, except that feedback cancellation element 650 modifies its operation according to information from compression element 640, and compression element 640 modifies its operation according to information from feedback cancellation 650.

An example of this is a combination of the processing described in conjunction with FIG. 4 with that described in conjunction with FIG. 5. The power estimated by the compressor or the detected envelope fluctuations in one or more bands is used to adjust the adaptive weight update, and the magnitude of the zero filter coefficient vector is used to adjust the compression gain or the compression attack and/or release times.

While the exemplary preferred embodiments of the present invention are described herein with particularity, those skilled in the art will appreciate various changes, additions, and applications other than those specifically mentioned, which are within the spirit of this invention. In particular, the present invention has been described with reference to a hearing aid, but the invention would equally applicable to public address systems, telephones, speaker phones, or any other electroacoustical amplification system where feedback is a problem.

What is claimed is:

1. A hearing aid comprising:

a microphone for converting sound into an audio signal;

feedback cancellation means including means for estimating a physical feedback signal of the hearing aid, and means for modelling a signal processing feedback signal to compensate for the estimated physical feedback signal;

subtraction means, connected to the output of the microphone and the output of the feedback cancellation means, for subtracting the signal processing feedback signal from the audio signal to form a compensated audio signal;

hearing aid processing means, connected to the output of the subtractor, for processing the compensated audio signal; and speaker means, connected to the output of the hearing aid processing means, for converting the processed compensated audio signal into a sound signal;

wherein said feedback cancellation means forms a feedback path from the output of the hearing aid processing means to the input of the subtracting means; and wherein said hearing aid processing means includes compression means for performing audio compression.

2. The hearing aid of claim 1, wherein the compression means and the feedback cancellation means operate in the time domain.

3. The hearing aid of claim 1, wherein the compression means and the feedback cancellation means operate in the frequency domain.

4. The hearing aid of claim 1, wherein the compression means operates in the time domain and the feedback cancellation means operates in the frequency domain.

5. The hearing aid of claim 1, wherein the compression means operates in the frequency domain and the feedback cancellation means operates in the time domain.

6. The hearing aid of claim 1, further including means for providing information from the feedback cancellation means to the compression means, and wherein said compression means adjust its operation based upon information provided by the feedback cancellation means.

7. The hearing aid of claim 6, wherein:

the feedback cancellation means includes a zero filter;

the hearing aid includes means for calculating a norm of a vector of coefficients of the hearing aid cancellation means zero filter; and the compression means modifies a gain value based on the norm.

8. The hearing aid of claim 6, wherein:

the feedback cancellation means includes a zero filter;

the hearing aid includes means for calculating a norm of a vector of coefficients of the hearing aid cancellation means zero filter; and the compression means modifies an attack time constant based on the norm.

9. The hearing aid of claim 6, wherein:

the feedback cancellation means includes a zero filter;

the hearing aid includes means for calculating a norm of a vector of coefficients of the hearing aid cancellation means zero filter; and the compression means modifies a release time constant based on the norm.

10. The hearing aid of claim 1, further including means for providing information from the compression means to the feedback cancellation means, and wherein said feedback cancellation means adjusts its operation based upon information provided by the compression means.

11. The hearing aid of claim 10, wherein:

the compression means includes means for separating the compensated audio signal into frequency bands and means for computing at least one power level for the frequency bands; and the feedback cancellation means modifies an adaptation step size according to at least one computed power level provided by the compression means.

12. The hearing aid of claim 10, wherein:

the compression means includes means for separating the compensated audio signal into frequency bands and means for computing at least one signal envelope peak to valley ratio for the frequency bands; and the feedback cancellation means modifies an adaptation step size according to at least one computed signal envelope peak to valley ratio provided by the compression means.

13. The hearing aid of claim 10, wherein:

the compression means includes means for separating the compensated audio signal into frequency bands, means for computing a power level for at least one frequency band, and means for computing a signal envelope peak to valley ratio for at least one frequency band; and the feedback cancellation means modifies an adaptation step size according to at least one computed power level and at least one computed signal envelope peak to valley ratio provided by the compression means.

14. The hearing aid of claim 1, further including means for providing information from the compression means to the feedback cancellation means and from the feedback cancellation means to the compression means, and wherein said feedback cancellation means adjusts its operation based upon information provided by the compression means, and said compression means adjusts its operation based upon information provided by the feedback cancellation means.

15. The hearing aid of claim 14, wherein:

the feedback cancellation means includes a zero filter;

the hearing aid includes means for calculating a norm of a vector of coefficients of the hearing aid cancellation means zero filter; and the compression means modifies a gain value based on the norm.

16. The hearing aid of claim 14, wherein:

the feedback cancellation means includes a zero filter;

the hearing aid includes means for calculating a norm of a vector of coefficients of the hearing aid cancellation means zero filter; and the compression means modifies an attack time constant based on the norm.

17. The hearing aid of claim 14, wherein:

the feedback cancellation means includes a zero filter;

the hearing aid includes means for calculating a norm of a vector of coefficients of the hearing aid cancellation means zero filter; and the compression means modifies a release time constant based on the norm.

18. The hearing aid of claim 14, wherein:

the compression means includes means for separating the compensated audio signal into frequency bands and means for computing at least one power level for the frequency bands; and the feedback cancellation means modifies an adaptation step size according to at least one computed power level provided by the compression means.

19. The hearing aid of claim 14, wherein:

the compression means includes means for separating the compensated audio signal into frequency bands and means for computing at least one signal envelope peak to valley ratio for the frequency bands; and the feedback cancellation means modifies an adaptation step size according to at least one computed signal envelope peak to valley ratio provided by the compression means.

20. The hearing aid of claim 14, wherein:

the compression means includes means for separating the compensated audio signal into frequency bands, means for computing a power level for at least one frequency band, and means for computing a signal envelope peak to valley ratio for at least one frequency band; and the feedback cancellation means modifies an adaptation step size according to at least one computed power level and at least one computed signal envelope peak to valley ratio provided by the compression means.

* * * * *